United States Patent [19]

Salazar

[11] 4,248,421

[45] Feb. 3, 1981

[54] CHEST EXERCISER

[76] Inventor: Maria V. Salazar, 1323 Washington St., Omaha, Nebr. 68107

[21] Appl. No.: 52,438

[22] Filed: Jun. 26, 1979

[51] Int. Cl.[3] ..... A63B 21/00

[52] U.S. Cl. ..... 272/130; 272/141

[58] Field of Search ..... 272/130, 126, 141, 143, 272/142; 292/347, 350

[56] References Cited

U.S. PATENT DOCUMENTS

| | | | |
|---|---|---|---|
| 104,420 | 6/1870 | Cady | 292/347 |
| 169,036 | 10/1875 | Rankin | 292/347 |
| 448,737 | 3/1891 | Trickel | 292/347 |
| 2,022,002 | 11/1935 | Jacks | 272/141 |
| 3,174,343 | 3/1965 | Kasulis | 272/130 |
| 3,836,141 | 9/1974 | Franklyn | 272/130 |
| 3,884,463 | 5/1975 | Malatesta | 272/130 |

FOREIGN PATENT DOCUMENTS

| | | | |
|---|---|---|---|
| 472335 | 9/1937 | United Kingdom | 272/141 |

*Primary Examiner*—Richard J. Johnson
*Attorney, Agent, or Firm*—Hiram A. Sturges

[57] ABSTRACT

A chest exerciser comprising a compressible spring member which is normally expanded in shape, handles which are of a shape easily and comfortably grasped and attached to ends of the spring member, the spring member resisting human arm pressure, urging compression thereof, the spring being of hollow thermoplastic material and the compression thereof being partially resisted by air pressure.

1 Claim, 2 Drawing Figures

CHEST EXERCISER

BACKGROUND OF THE INVENTION

One of the more important parts of any chest exerciser is its handles. Handles that are easy and comfortable to grasp allow the person to use all of his effort and strength in exercising the muscles of the chest. On the other hand, handles which are not easy and comfortable to grasp require the person exercising to expend a great deal of effort, simply in holding the device.

The handles of my invention are constructed with the outer sides of the handles rounded so as to fit the natural shape of a person's hand, but the inner sides have concave areas allowing the handles to be easily grasped by the fingers and thumb.

In addition to this, my handles are large enough so that the person can use the entire palms of the hands when compressing the exerciser. Thus pressure can be comfortably applied by the chest muscles.

It is one of my concepts to provide a chest exerciser that combines both air pressure and spring action resistance to compression and the two bond themselves to be effectively used by both weak and strong persons.

My chest exerciser is economically constructed of only three parts, a spring and two handles. These parts fit together easily and require little in the way of assembly costs.

It is also important that an invention of this type be attractive. The use of a plastic bellow spring is much more attractive than springs made of other materials.

SUMMARY OF THE INVENTION

The main goal of this invention is to provide a chest exerciser comprising a compressible spring member which is normally expanded in shape, handles which are of a shape easily and comfortably grasped and attached to ends of the spring member, the spring member resisting human arm pressure, urging compression thereof, the spring being of hollow thermoplastic material and the compression thereof being partially resisted by air under pressure.

Another goal is to provide handles of disc shape in end elevation so that the pressure of compressing the spring is distributed over the entire palms of the hands.

Still another goal is to provide the handles with circular concave portions on their inner sides for receiving the tips of the fingers.

Yet another goal is to provide for threaded connection of the spring to the handles.

DESCRIPTION OF THE PREFERRED EMBODIMENT

Figure 1:
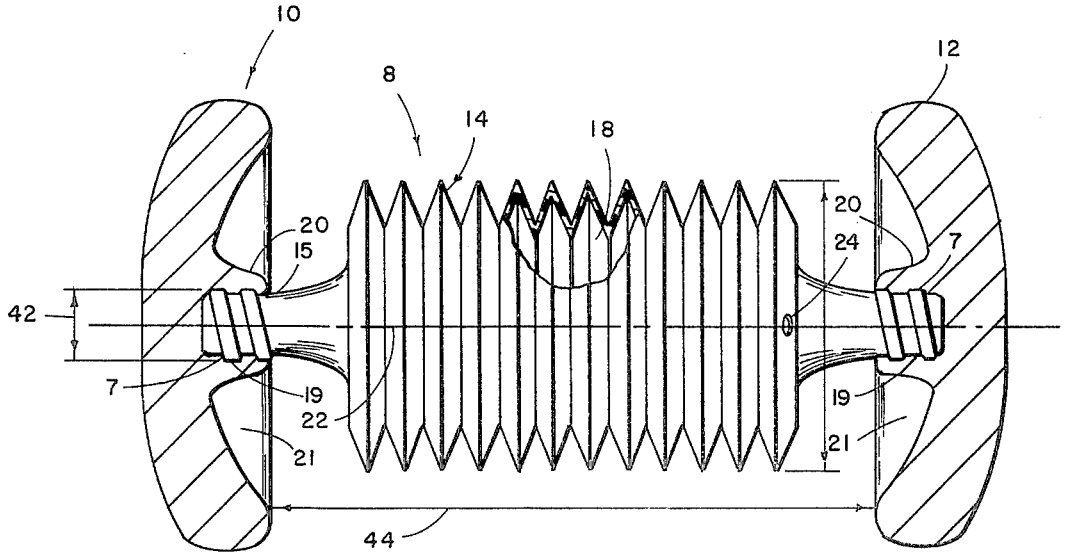
FIG. 1 is a side elevation of the chest exerciser of this invention with the closer half of each of two handles and a portion of a thermoplastic spring removed.

The chest exerciser of this invention is generally indicated at 8 and comprises two handles 10 and 12, connected by means of a hollow resilient plastic spring 14, having an open center 15 like a bellows. In my opinion, steel springs would not be attractive enough. The spring 14 is held to each handle by means of threaded protrusions 15, having external threads 18 received in internally threaded sockets 19 in the handle protrusions 20 on the inner sides of the handles.

When the exerciser is expanded, the distance between the handles approximates the convenient position of the hands held in front of the chest. When the handles are pressed together and the plastic spring 14 is compressed and many muscles, primarily the chest and shoulder muscles, are exercised and developed.

The spring 14 is constructed of a resilient plastic, which will return by itself to its original shape after the handles are released. Thus the person exercising only presses the exerciser together and does not have to pull it apart as well although he can if he wishes.

The handles are of a round shape, as seen along the axis 20 of the spring, which allows them to be grasped easily and comfortably by the person exercising, and this also allows a person to use the entire palm of his other hand to compress the exerciser. When the handles are grasped the fingers fit comfortably into a circular concave portion 21 of each handle, which is very important.

The handles must be of an especially sturdy construction and so are extra thick, as is very important, at the point where the plastic spring 14 and protrusions 15 are threaded to the handle, as shown at handle protrusions 20.

When the plastic spring bellows are compressed and expanded, air escapes from and enters the plastic spring bellows through an air hole 24. The size of the air hole 24 can partly determine the pressure necessary to compress the spring 14, if desired. The air hole 24 is vital or the hollow plastic bellows spring will not compress.

The hollow center 18 of the plastic spring 14 extends throughout the spring on the inside of the corrugated walls thereof, and the outer sides of the spring can also be seen to be corrugated. Any part of the spring in vertical cross section would be circular in shape on both inner side and outer side.

As the spring 14 is compressed air escapes out through a hole 24 and the size of the hole regulates the amount of speed with which the spring can be compressed. However, it is a desirable way to have substantially all the resistive force to compression being provided by the material of the spring itself, and none of it by compression resisted by air pressure and in such case the hole 24 is quite large so that air easily escapes.

Figure 2:
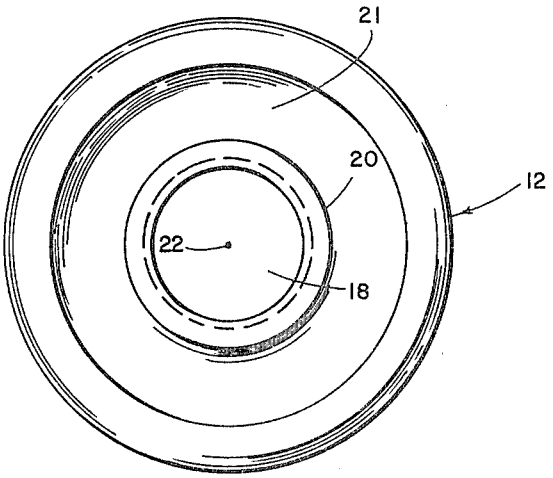
FIG. 2 is a view of the right handle of FIG. 1 as it would be seen from the left or inner side but with a center opening modified to receive a larger threaded protrusion of the spring than is the case in FIG. 1.

The outer diameter of the threaded protrusions 19 is indicated by an arrow 42 and can be one and one fourth inches as an ideal for strength, as shown in the modification of FIG. 2, or it can be smaller as shown in FIG. 1. The distance along the arrow 44 between the handles can vary, but a maximum distance when the exerciser is at rest, is preferably approximately six inches. The outer diameter of the handles is preferably five inches.

The handles are convex on their outer sides and at their central portions and at their outer edges to provide comfortable smooth surfaces.

Glue at 7 in FIG. 1 can be used to hold the protrusions 15 to the handles.

I claim:

1. A chest exerciser comprising a compressible spring means normally expanded in shape, a right and left handle, said right and left handles being attached to opposite ends of said spring means, said spring being made of thermoplastic material, and having a hollow center, said spring having corrugated sides to facilitate compression, an air escape means operatively associated with said spring through which air passes when said spring is compressed or expanded, said handles being in a disc shape, so that the entire palm of a hand can be used to compress said spring, said spring having an axis of compression, said handles being transverse to said axis, said handles being rounded on their exterior surfaces so as to comfortably fit one's hands, said spring having plastic threaded portions at its ends, said handles being provided with threads adjacent said axis, said handles being threadedly mounted on said threaded portions of said spring, said air escape means comprising a hole means in said spring, said handles being concave on their inner sides between their outer edges and said threaded portions, all outer surfaces of said handles being substantially blunt for comfort when gripped against.

* * * * *